US005359950A

United States Patent [19]

Schellas

[11] Patent Number: 5,359,950

[45] Date of Patent: Nov. 1, 1994

[54] TEAR-RESISTANT SEAMS INCLUDING MULTIPLE AND OVERLAPPING STITCHES FOR CLOTHING

[76] Inventor: Patricia Schellas, 1015 Hastings Ave., Baldwin, N.Y. 11510

[21] Appl. No.: 143,300

[22] Filed: Oct. 26, 1993

[51] Int. Cl.[5] ..... D05B 3/02; D05B 1/18; A41D 27/24

[52] U.S. Cl. ..... 112/417; 112/160; 112/269.1; 2/275

[58] Field of Search ..... 112/157, 160, 162, 266.1, 112/269.1, 417, 418, 419, 429, 433, 439, 440, 441, 454; 2/248, 274, 275

[56] References Cited

U.S. PATENT DOCUMENTS

| | | | |
|---|---|---|---|
| 174,764 | 3/1876 | Blanchard | 112/441 X |
| 218,220 | 8/1879 | Bigelow | 112/417 X |
| 857,294 | 6/1907 | Montgomery | 112/441 X |
| 1,467,626 | 9/1923 | Tucker | 112/417 |
| 2,330,459 | 9/1943 | Tweedie | 112/262.1 |
| 3,010,114 | 11/1961 | Lipschultz | 112/417 X |
| 3,151,588 | 10/1964 | Wolkowitz | 112/427 |
| 4,466,370 | 8/1984 | Eguchi et al. | 112/269.1 |
| 4,561,369 | 12/1985 | Meier | 112/262.1 |
| 4,622,908 | 11/1986 | Tranberg | 112/262.2 |
| 4,996,932 | 3/1991 | Nishimaki | 112/157 |
| 5,111,758 | 5/1992 | Nufer et al. | 112/266.1 |

FOREIGN PATENT DOCUMENTS

| | | | |
|---|---|---|---|
| 2368565 | 5/1978 | France | 112/418 |
| 0075451 | 5/1931 | Sweden | 112/418 |

*Primary Examiner*—Clifford D. Crowder
*Assistant Examiner*—Ismael Izaguirre
*Attorney, Agent, or Firm*—Collard & Roe

[57] ABSTRACT

A method utilizes a group of four stitchings and a nylon cord which are implemented into the seam of an article of clothing to create a tear-resistant seam. The first step in the sequence of stitching is a serging stitch which attaches the two pieces of material together, creating a seam. The second step is to sew a nylon cord in the seam created by the serging stitch by way of a first zigzag stitch. The first serging stitch and the first zigzag stitch are adjacent to each other and do not overlap one another. The third step is to stitch two lines of straight stitching adjacent to each other and directly adjacent to the first zigzag stitch of the second step. The fourth and final step is a second zigzag stitch which will overlap the first zigzag stitch and the first of the two lines of straight stitch of the third step. Upon completion of these four steps, the newly created seam is tear-resistant.

11 Claims, 1 Drawing Sheet

TEAR-RESISTANT SEAMS INCLUDING MULTIPLE AND OVERLAPPING STITCHES FOR CLOTHING

BACKGROUND OF THE INVENTION

1. Field of the Invention

The present invention relates to a stitching pattern that enables fabrics or clothing to be tear-resistant, and also relates to a method for manufacturing fabric or an article of clothing that has tear-resistant seams.

2. The Prior Art

Certain people have a mental problem or disorder causing them to tear their clothing. Thus, there is a tremendous need in this special population for tear-resistant clothing.

It would be desirable to find durable tear-resistant clothing for persons who exhibit abnormal behaviors such as ripping of clothing and destruction of property. Finding such clothing would enable these people to live a more normalized and dignified life while having their destructive behaviors addressed in a formal program.

Attempts have been made in the past to solve these problems, and prior art proposals are as follows.

The Tranberg U.S. Pat. No. 4,622,908 discloses a method of manufacturing sleeve shaped body protectors by modifying the seaming of a sleeve-like article of clothing. The sleeve is created by bringing the two ends of the material together, at which point a strip of fabric is placed over the joint of the two ends. Then the two ends and strip of fabric are sewn together to create the seam. The sewing machine used has at least two needles for each side of the joint to be sewn. The object of this sewing machine design is for criss-crossing the threads from the needles to opposite sides of the joint, and across the joint at the face of the cloth remote from the fabric strip (i.e., on the underside of the seam).

The Eguchi et al. U.S. Pat. No. 4,466,370 discloses a method for forming hemstitches using a zigzag stitch process. The process consists of two zigzag stitches that act in conjunction with a series of straight stitches made parallel to and spaced inside the edge of the fabric. The first of the zigzag stitches is of a predetermined width such that the stitches extend between the edge of the fabrics and the straight stitches. The second zigzag stitching extends between the first zigzag stitches and the straight stitching such that the second zigzag stitch has a plurality of seams connected to the first zigzag stitch and the straight stitch.

The Wolkowitz U.S. Pat. No. 3,151,588 discloses a curtain having adjacent panel edges concealed by ornamental stitching. Two adjacent panels (i.e., pieces of fabric or other material used for curtains) are sewn together by a stitching method whereby the seam created by the two panels is not noticeable. In one embodiment, there is one plurality of longitudinally extending zigzag stitching that would connect the two adjacent panels to one another. A first plurality of longitudinally extending straight stitching would then be applied over the first zigzag stitching on both sides of the seam created to secure the zigzag stitching in place. A second plurality of longitudinally extending zigzag stitching is then applied to each adjacent panel space vertically from the first plurality of zigzag stitching. A second plurality of longitudinally extending straight stitching is then applied over the second zigzag stitching, thereby securing the second zigzag stitch in place.

The Nishimaki U.S. Pat. No. 4,996,932 discloses a multiple needle pattern stitching sewing machine capable of making stitch tracings in zigzag or other similar design on a cloth by moving a plurality of needles up and down and moving the cloth being sewn right and left at the corresponding time with the motion of the needles.

The Tweedie U.S. Pat. No. 2,330,459 discloses a shoe with a reinforced stitching which consists of a lock stitch type which comprises three rows of zigzag stitches staggered with relation to the stitches in the adjacent row. The application of this stitching design deals with uniting an elastic webbing tape to a shoe upper member in an edgewise abutting relation, especially where such upper member is made of stretchable leather or elasticized material.

The Meier U.S. Pat. No. 4,561,369 discloses a sewn pattern arrangement to be produced by a zigzag sewing machine, and consists of a method whereby ornamental patterns adjacent to one another are sewn into the fabric (i.e., clothing) through the use of a zigzag sewing machine.

The Nufer et al. U.S. Pat. No. 5,111,758 discloses a method for making groups of sewn patterns with zigzag sewing machines.

All of these prior art references fail to recognize the problem of providing fabrics or articles of clothing with tear-resistant seams.

SUMMARY OF THE INVENTION

It is an object of the present invention to provide a stitching pattern that permits fabrics and articles of clothing to have tear-resistant seams.

The above object is accomplished according to the present invention by providing a stitching pattern for creating a tear-resistant seam to join together two pieces of fabric. The seam includes a serging stitch for attaching the two pieces of fabric to create a seam. Then there is a first zigzag stitch for sewing a cord into the seam created by the serging stitch. A first line of straight stitching is adjacent to the zigzag stitch, and then there is a second line of straight stitching adjacent to the first line of straight stitching. Finally, a second zigzag stitch overlaps the first zigzag stitch and the first line of straight stitching.

The invention also includes a method by which a group of four stitchings and a cord are implemented into the seam of an article of clothing creating a tear-resistant seam. The first step in the sequence of stitching is a serging stitch which attaches the two pieces of material together, creating a seam. The second step is to sew a cord, such as nylon cord, into the seam created by the first serging stitch by way of a first zigzag stitch. The serging stitch and the first zigzag stitch are adjacent to each other and do not overlap. The third step is to stitch two lines of straight stitching adjacent to each other and directly adjacent to the aforementioned zigzag stitch of the second step. The fourth and final step is a second zigzag stitch which overlaps the first zigzag stitch of the second step and the first of the two lines of straight stitch of the third step. Upon completion of these four steps, the newly created seam is tear-resistant.

Suitable examples of tear-resistant clothing produced according to the present invention include pants, jumpsuits, warm-up suits, shirts and underwear, as well as tear-resistant sheets, comforters and pillowcases.

BRIEF DESCRIPTION OF THE DRAWINGS

Other objects and features of the present invention will become apparent from the following detailed description considered in connection with the accompanying drawings which discloses embodiments of the present invention. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
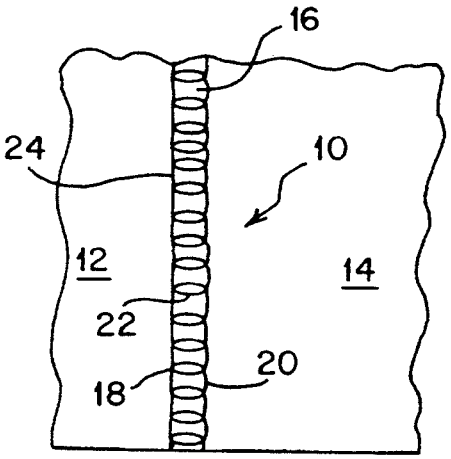
FIG. 1 shows a serging stitch initially attaching the two ends of clothing material to create a seam.

Turning now in detail to the drawings, FIG. 1 shows a stitching pattern 10 which is applied to two pieces of fabric or cloth 12 and 14 to create a tear-resistant seam 16 for the fabric or cloth 12 and 14. The first piece of cloth 12 has a free end 18 and the second piece of cloth 14 has a free end 20, which are caused to overlap 22 each other in such a manner that a serging stitch 24 can be applied to this overlap 22 in a first step of the stitching sequence.

As another embodiment, the two pieces of cloth can be part of the same fabric material, rather than being two separate and distinct fabrics.

Figure 2:
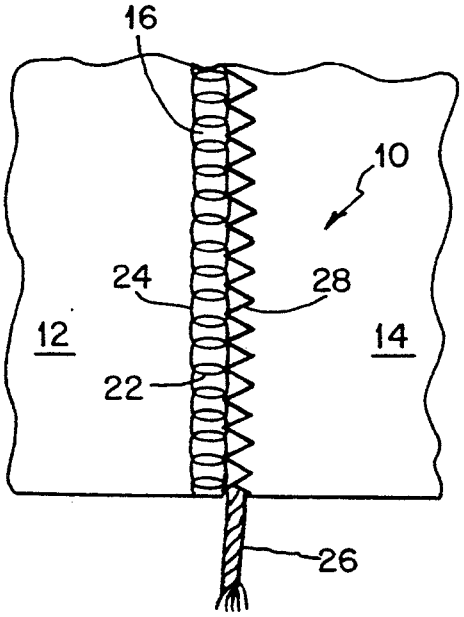
FIG. 2 shows a cord sewn into the seam by way of a first zigzag stitch.

FIG. 2 shows the second step in the sequence of stitching pattern 10 in which a cord of material 26, such as nylon cord or string, is sewn into the seam 16 created by the initial serging stitch 24 by way of a first zigzag stitch 28.

Figure 3:
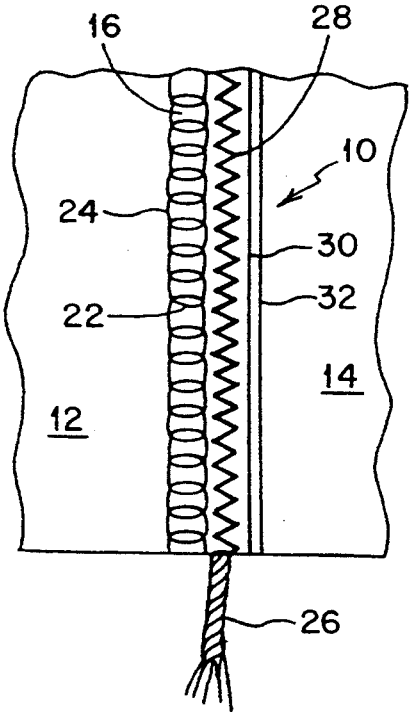
FIG. 3 shows two lines of straight stitching adjacent to each other and adjacent to the zigzag stitch.

FIG. 3 shows the third step in the sequence of stitching pattern 10 in which a first line 30 of straight stitching is sewn into the seam 16, adjacent to the first zigzag stitch 28. Then a second line 32 of straight stitching is sewn into the seam 16 adjacent to the first line 30.

Figure 4:
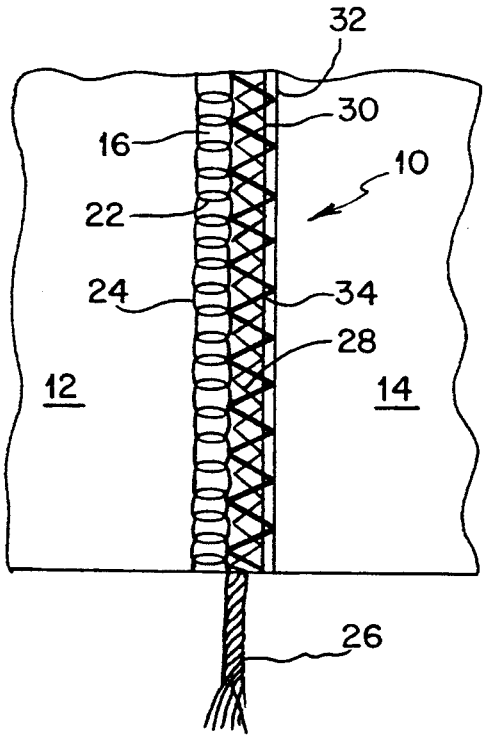
FIG. 4 shows a second zigzag stitch which overlaps the first zigzag stitch and the first of the two lines of the straight stitch.

FIG. 4 shows the fourth step in the sequence of stitching pattern 10 in which a second zigzag stitch 34 is sewn so as to overlap the first zigzag stitch 28 and to overlap the first line 30 of straight stitching. However, the second line of straight stitching 32 is not affected by this second zigzag stitch 34.

The thread utilized to produce the stitching of the invention can be of any conventional color and diameter used in the apparel manufacturing industry. Also, the sewing machine utilized to produce the stitching of the invention can be from any known manufacturer of sewing machines that are capable of producing a variety of stitchings. For example, the sewing machine described in the Nishimaki U.S. Pat. No. 4,996,932, the Meier U.S. Pat. No. 4,561,369 or the Nufer et al. U.S. Pat. No. 5,111,758 can be utilized. Each patent disclosure is herewith incorporated by reference.

While several embodiments of the present invention have been shown and described, it is to be understood that many changes and modifications may be made thereunto without departing from the spirit and scope of the invention as defined in the appended claims.

What is claimed is:

1. A stitching pattern for creating a tear-resistant seam to join together two pieces of fabric, comprising a serging stitch for attaching the two pieces of fabric to create a seam;

a first zigzag stitch for sewing a cord into the seam created by the serging stitch;

a first line of straight stitching adjacent to said first zigzag stitch;

a second line of straight stitching adjacent to said first line of straight stitching; and a second zigzag stitch which overlaps said first zigzag stitch and said first line of straight stitching.

2. The stitching pattern of claim 1, wherein said cord is made of nylon.

3. The stitching pattern of claim 1, wherein said serging stitch and said first zigzag stitch do not overlap one another.

4. The stitching pattern of claim 1, wherein the two pieces of fabric are part of the same cloth material.

5. The stitching pattern of claim 1, wherein the two pieces of fabric are each part of two separate and distinct cloth materials.

6. An article of clothing having the stitching pattern of claim 1 for creating a tear-resistant seam therein.

7. A method of creating a tear-resistant seam in a fabric comprising bringing together two unattached ends of a fabric;

sewing a serging stitch into said fabric for attaching said two ends to create a seam;

sewing a first zigzag stitch into said fabric adjacent to said serging stitch for attaching a cord in the seam between said serging stitch and said first zigzag stitch;

sewing a first line of straight stitching into said fabric adjacent to said first zigzag stitch;

sewing a second line of straight stitching into said fabric adjacent to said first line of straight stitching; and sewing a second zigzag stitch into said fabric to overlap the first zigzag stitch and to overlap the first line of straight stitching;

whereby a tear-resistant seam is created in the fabric.

8. The method of claim 7, wherein said cord is made of nylon.

9. The method of claim 7, wherein said serging stitch and said first zigzag stitch do not overlap one another.

10. The method of claim 7, wherein the two pieces of fabric are part of the same cloth material.

11. The method of claim 7, wherein the two pieces of fabric are each part of two separate and distinct cloth materials.

* * * * *